United States Patent [19]

Van Auken et al.

[11] 4,189,143

[45] Feb. 19, 1980

[54] TENNIS SCOREKEEPER

[76] Inventors: John A. Van Auken; Lorraine A. Van Auken, both of 16 La Gorce Cir., Miami Beach, Fla. 33141

[21] Appl. No.: 821,358

[22] Filed: Aug. 3, 1977

[51] Int. Cl.[2] ..... A63B 71/00

[52] U.S. Cl. ..... 273/73 R; 235/1 B; 116/222; 40/491

[58] Field of Search ..... 273/67 R, 73 R, 162 A; 235/1 B; 116/130, 131, 133–136.5; 40/489–491, 493, 495, 508, 509, 109, 110

[56] References Cited

U.S. PATENT DOCUMENTS

| | | | |
|---|---|---|---|
| 434,425 | 8/1890 | Cooper | 273/73 R |
| 448,878 | 3/1891 | Clarke | 273/73 R |
| 2,759,666 | 8/1956 | Wyckoff | 116/135 X |
| 2,813,504 | 11/1957 | Johnson | 116/135 |
| 3,343,290 | 9/1967 | Madansky | 40/488 |
| 3,468,541 | 9/1969 | Herring | 116/135 X |
| 3,485,204 | 12/1969 | Christman | 40/491 X |
| 3,584,597 | 6/1971 | Simmons | 40/491 X |
| 3,730,131 | 5/1973 | Izzo | 116/133 X |
| 3,777,699 | 12/1973 | Pfleger | 116/133 X |
| 3,847,110 | 11/1974 | Inoue | 116/133 X |
| 3,903,837 | 9/1975 | Barton et al. | 116/133 |
| 3,921,568 | 11/1975 | Fish | 116/133 X |
| 3,986,715 | 10/1976 | Glick | 273/73 R |
| 4,132,187 | 1/1979 | Moebius | 40/491 |

FOREIGN PATENT DOCUMENTS

| | | | |
|---|---|---|---|
| 2544853 | 4/1977 | Fed. Rep. of Germany | 273/73 R |
| 19853 | of 1898 | United Kingdom | 273/73 R |
| 22925 | of 1913 | United Kingdom | 273/73 R |
| 607981 | 9/1948 | United Kingdom | 40/491 |

*Primary Examiner*—Richard J. Apley
*Attorney, Agent, or Firm*—LeBlanc, Nolan, Shur & Nies

[57] ABSTRACT

A tennis scorekeeping device having a pair of separately formed scorekeeping units adapted to be mounted one each side of a tennis racquet handle between the head of the racquet and the handle grip of the racquet, first manually manipulatable means on one of said units for scoring game points won by opposing players, and second manually manipulatable means on the other of said units for scoring the games won by opposing players.

14 Claims, 20 Drawing Figures

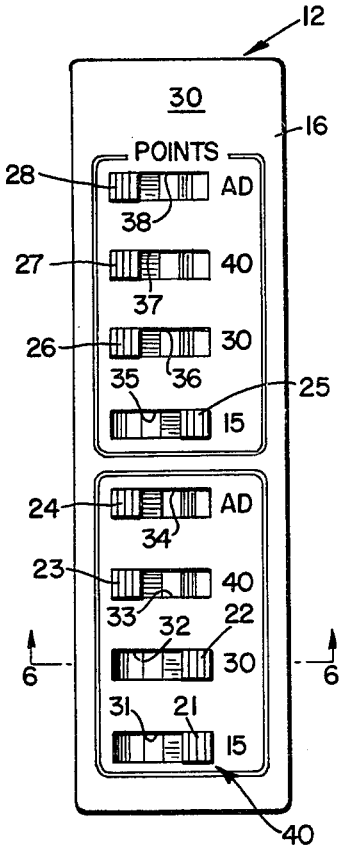
FIG.1A
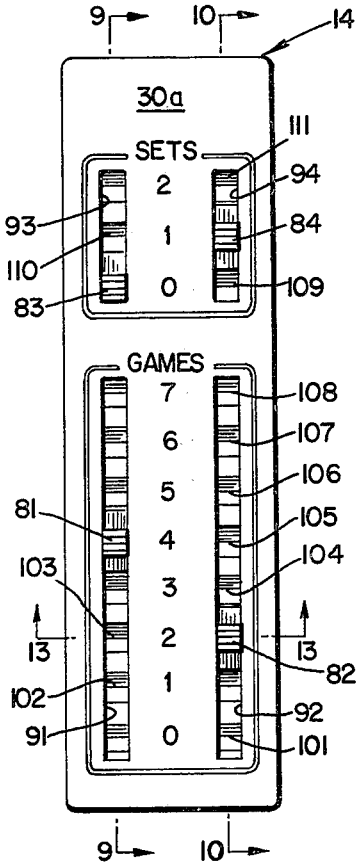
FIG.1B
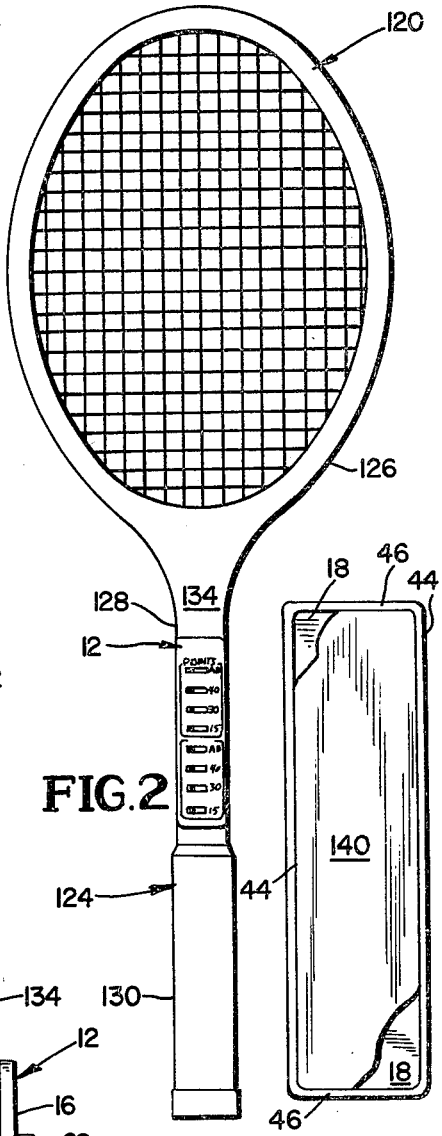
FIG.2
FIG.5
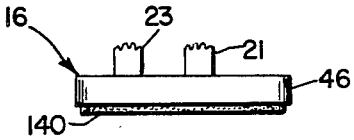
FIG.5A
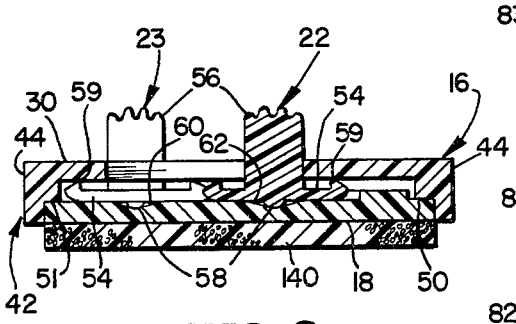
FIG.6
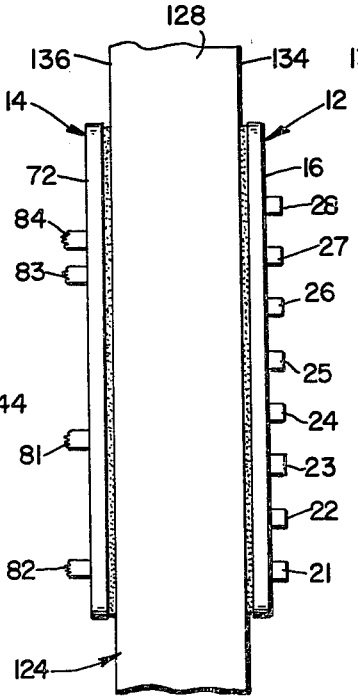
FIG.4
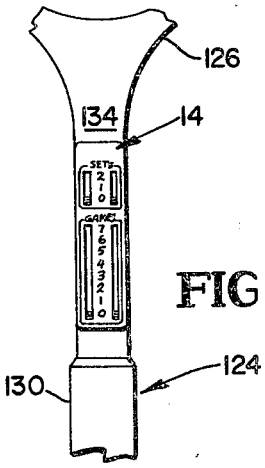
FIG.3

FIG. 7
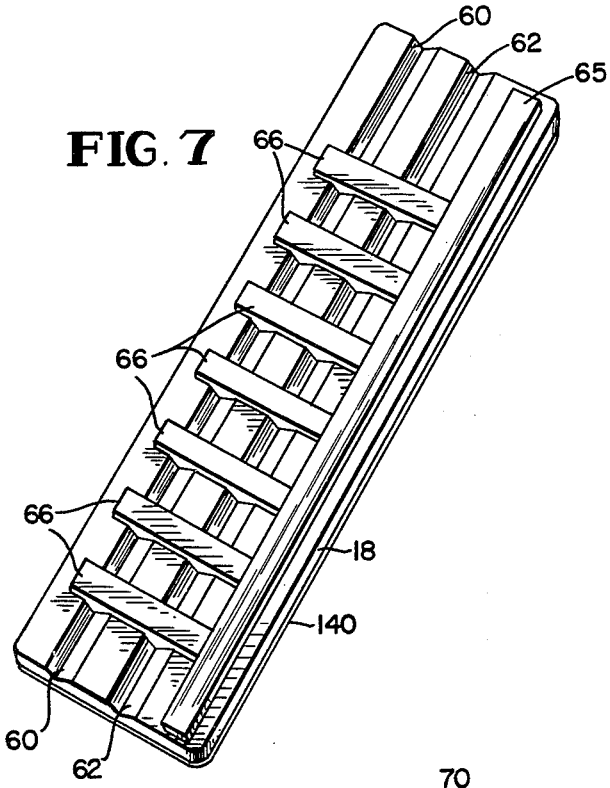
FIG. 9
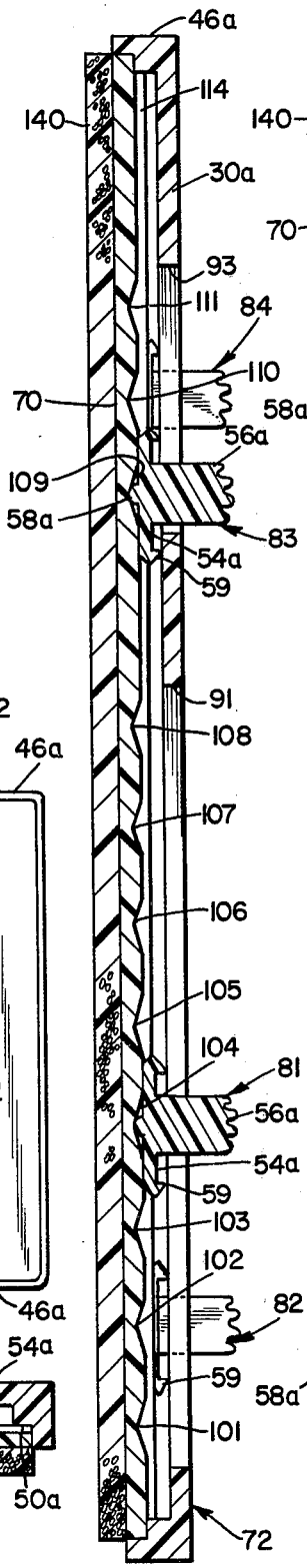
FIG. 10
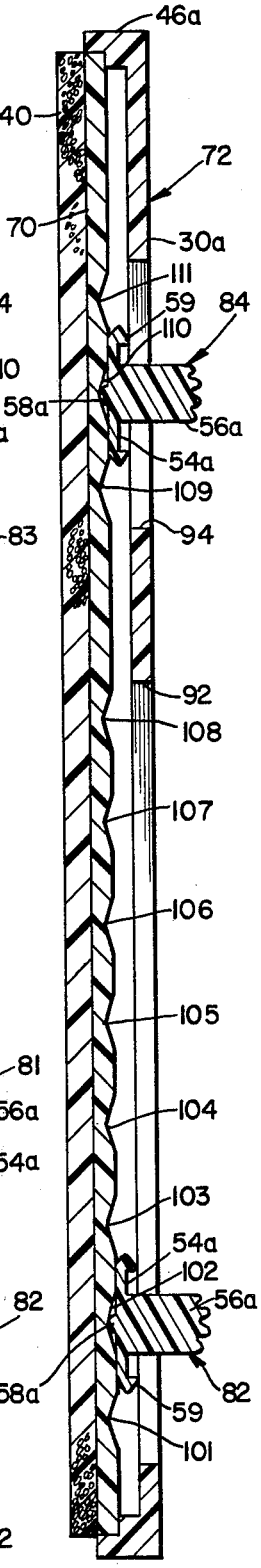
FIG. 12
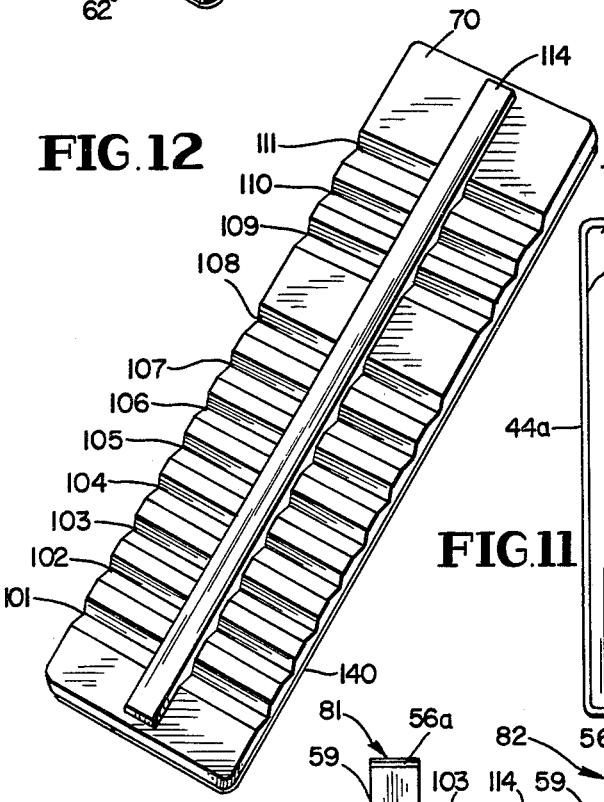
FIG. 11
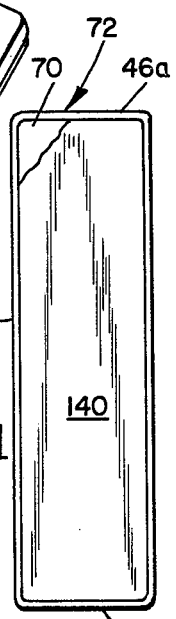
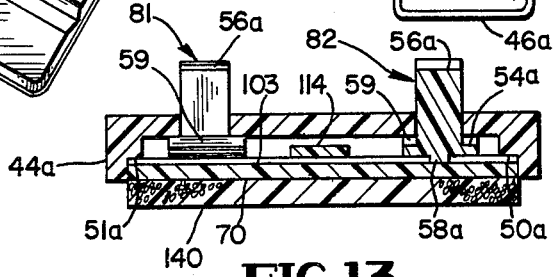
FIG. 13

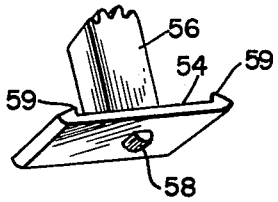
FIG. 8
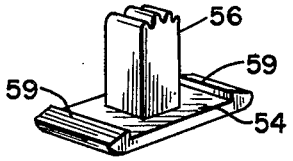
FIG. 8A
FIG. 14
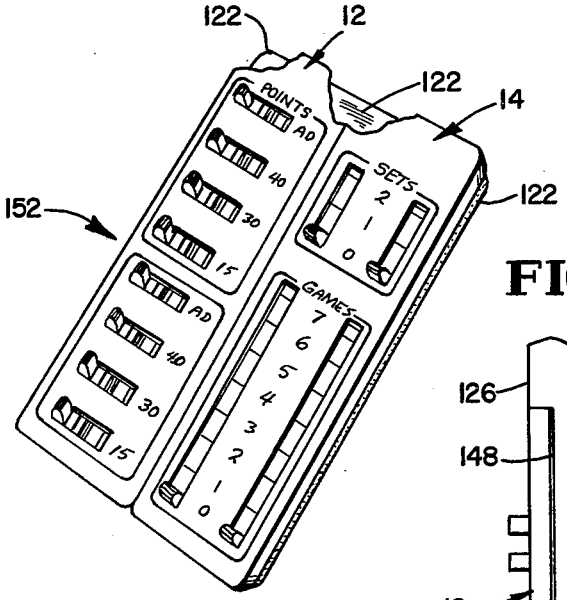
FIG. 15
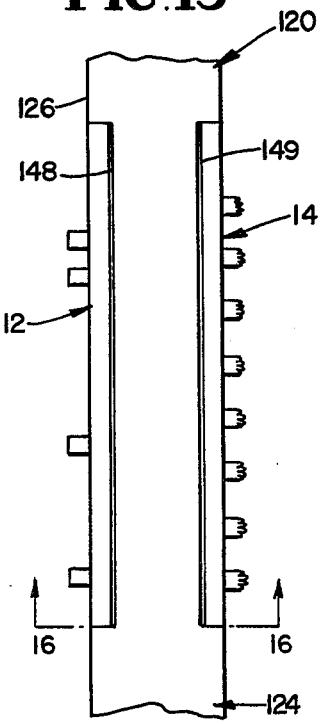
FIG. 16
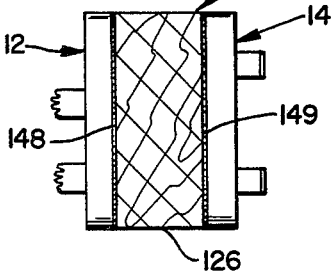
FIG. 17
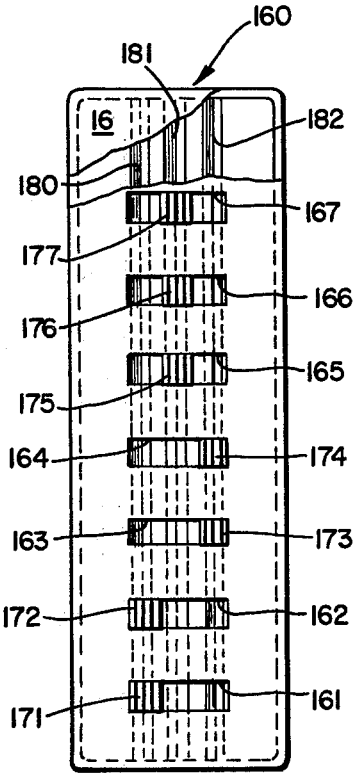

TENNIS SCOREKEEPER

FIELD OF INVENTION

This invention relates to tennis scorekeeping devices.

BACKGROUND

With the rising interest in tennis a need has developed for a simplified, easy-to-use device for keeping score as the game progresses.

Prior to this invention a number of dial-type tennis scorekeeping devices have been proposed similar to devices used to keep golf scores. For the most part these dial-type tennis scorekeeping devices are adapted to be worn on the user's wrist, like a wrist watch, or mounted on the butt end of a tennis racquet handle. These dial-type scorekeepers suffer from a number of significant disadvantages and drawbacks which circumscribe their utility.

First, the advancement of the dial to the next highest score is difficult and cumbersome while holding a tennis racquet in one hand and tennis balls in the other. Second, the size of the numerals visible through a viewing window are usually small, thus making them difficult to read, especially for persons who use reading glasses. Third, these prior scorekeepers are not equipped for scoring all three tennis requirements, namely, points, games and sets.

SUMMARY AND OBJECTS OF INVENTION

A major object of this invention is to provide a novel tennis scorekeeping device which is not subject to the above disadvantages.

According to the preferred embodiment, the tennis scorekeeper of this invention is a two part or dual unit assembly. One part or unit is advantageously used to indicate the point score, and the other part or unit is used to indicate the score in games and sets. Both scorekeeping units are constructed separately of each other and are adopted to be mounted on opposite sides of the racquet handle, preferably in the region of the racquet's center of gravity, to provide a balanced assembly with the racquet. When the two scorekeeping units are mounted in this fashion, they sandwich the racquet handle.

Both scorekeeping units are slim and elongated in the direction of the racquet handle so that they do not extend beyond the side edges of the racquet handle for most tennis racquet constructions. The separate scorekeeping units of this invention are therefore easily accessible for manipulation and do not interfere with the use of the racquet or upset the racquet's balance.

For registering or recording the score in points, games and sets, the two scorekeeping units of this invention are provided with plural-position, manually-manipulatable indexing elements. In the preferred embodiment, these indexing elements are in the form of button-like slides which are manually shiftable by the flick of the player's thumb to provide an indication of the score. The slides are easy to operate and are efficiently organized with score-indicating numerals or characters (e.g., ADD) to enable the score to be read easily and quickly.

Instead of mounting the two scorekeeping units on the racquet handle as described above, they may alternatively be mounted on a mounting racquet or backing pad at the user's option so that the resulting assembly is a single unit which can conveniently be handheld for use by a spectator or an umpire.

With the foregoing in mind another important object is to provide a novel tennis scorekeeping device which is easily and conveniently manually manipulatable by the thumb of either hand.

Still another important object of this invention is to provide a novel hand-held or racquet-mounted tennis scorekeeping device which is equipped to score games and sets as well as game points.

Another important object of this invention is to provide a novel lightweight tennis scorekeeping device which is adapted to be mounted on the handle of a tennis racquet at the racquet's center of gravity in such a manner that it does not noticeably upset the balance of the racquet.

Still another important object of this invention is to provide a novel tennis scorekeeper on which the score in points, games and sets is easily readable.

Still another object of this invention is to provide a novel tennis scorekeeping device of rugged, low cost, efficiently organized construction.

Further objects of this invention will appear as the description proceeds in connection with the appended claims and below described drawings.

DESCRIPTION OF DRAWINGS

FIG. 1A is a top plan view of the other of the two scorekeeping units of the dual unit tennis scorekeeping device of this invention;

FIG. 1B is a top plan view of the other of the two scorekeeping units of the dual unit tennis scorekeeping device of this invention;

FIG. 2 is a plan view of one side of a tennis racquet showing one of the two scorekeeping units mounted on the tennis racquet handle;

FIG. 3 is a fragmentary plan view of the opposite side of the tennis racquet showing the other of the two scorekeeping units on the racquet handle;

FIG. 4 is a fragmentary left hand end elevation of the tennis racquet shown in FIGS. 2 and 3;

FIG. 5 is a bottom plan view of the scorekeeping unit shown in FIG. 1A;

FIG. 5A is an end elevation of the scorekeeping unit shown in FIG. 1A;

FIG. 6 is a section taken substantially along lines 6—6 of FIG. 1A;

FIG. 7 is a perspective view of the scorekeeping unit's base shown in FIGS. 5 and 6;

FIGS. 8 and 8A are perspective views of one of the indexing slides shown in FIGS. 1A and 1B;

FIGS. 9 and 10 are sections respectively taken along lines 9—9 and 10—10 of FIG. 1B;

FIG. 11 is a bottom plan view of the scorekeeping unit shown in FIG. 1B;

FIG. 12 is a perspective view of the scorekeeping unit's base shown in FIGS. 9–11;

FIG. 13 is a section taken substantially along lines 13—13 of FIG. 1B;

FIG. 14 is a perspective view of the two scorekeeping units assembled as a single hand-held unit on a base mounting plate;

FIG. 15 is an elevation similar to FIG. 4, but illustrating a modified racquet handle construction having recesses to receive the scorekeeping units;

FIG. 16 is a section taken substantially along lines 16—16 of FIG. 15; and FIG. 17 is a plan view of a modified scorekeeping unit for scoring points in a game.

DETAILED DESCRIPTION

Referring to the drawings and particularly to FIGS. 1A and 1B, the tennis scorekeeping device incorporating the principles of this invention is shown to comprise a pair of separate scorekeeping units 12 and 14. In this embodiment, unit 12 (see FIG. 1A) is used to record game points for the opposing players and unit 14 (see FIG. 1B) is used to record games and sets won by the opposing players.

As shown in FIGS. 1A, 5 and 6, the scorekeeping unit 12 comprises a rectangular base 18, a rectangular cover 16 overlying and seated on base 18, and eight individual indexing buttons or slides 21, 22, 23, 24, 25, 26, 27 and 28. Cover 16 and base 18 are formed separately of each other, and each may be of one-piece construction.

Slides 21–28 are divided into two groups of four each, with slides 21–24 being used to record points won by one player or one pair of players, and with slides 25–28 being used to indicate points won by the opposing player or pair of players.

Cover 16, base 18 and slides 21–28 are advantageously molded from a suitable plastic material. Cover 16 and base 18 are firmly joined together by a suitable adhesive.

Cover 16 is formed with a top wall 30 and a depending skirt 42. Eight rectangular coextensive apertures or slots 31, 32, 33, 34, 35, 36, 37 and 38 are formed through the cover's top wall 30, one for each of the slides 21–28. Apertures 31–38 extend transversely of cover 16 and are arranged in parallel, side-by-side spaced apart relationship in a straight row which is indicated at 40 in FIG. 1A.

As shown in FIGS. 5 and 6, the depending skirt 42 of cover 16 is formed by parallel, spaced apart elongated side walls 44 extending perpendicularly between short end walls 46. Apertures 31–38 are elongated in a direction that is normal to the direction in which cover 16 is elongated so that a plane normally intersecting apertures 31–38 is parallel to the elongated side walls 44.

Slides 21–28 extend through apertures 31–38, respectively, for manipulation by the user. As viewed from FIG. 1A, slides 21–28 are slidably shiftable longitudinally along its associated apertures (31–38) between a non-recording position at the left-hand end of its associated aperture and a point-recording or indicating position at the right-hand end of its associated aperture. Slides 21–28 are confined against lateral movement in their respective apertures by abutment with the side edges of the apertures.

The point score characters 15, 30, 40 and ADD are boldly printed on cover 16 adjacent to the right-hand edges of apertures 31–34, respectively. Apertures 31–34 are the first four apertures in row 40 and are arranged one after the other to form a group for indicating the points won by one player in the case of singles or one pair of players in the case of doubles.

Similarly, the point score characters 15, 30, 40 and ADD are boldly printed on cover 16 adjacent to the right-hand edges of apertures 35–38. Apertures 35–38 are the last four apertures in row 40 and are arranged one after the other to form a second group for indicating the points won by the opposing player or pair of players as the case may be.

From the description thus far it is apparent that the scorekeeping operation of unit 12 is simple and easy. For example, assume players A and B are playing singles. The two groups of point-indicating slides are arbitrarily assigned one to each player. The first group of slides 21–24, for instance, may be assigned to player A, leaving the second group of slides 25–28 for player B.

Before starting the game, all of the slides 21–28 are shifted to their non-recording left-hand positions. If the first point in the game is won by player A, slide 21 is shifted to its extreme, right-hand position, thus recording the point in player A's favor. If player B wins the second point, slide 25 is shifted to its extreme right-hand position, so that the indicated score becomes 15 all. Recording of game points is continued in this manner as each point is played. The score indicated by the slide positions shown in FIG. 1A, as an example, is 30–15 in favor of player A. Upon completion of the game, all of the slides 21–28 are returned to their non-recording left-hand positions in preparation for the next game.

As shown in FIG. 6, skirt 42 is formed with a flat, continuous internal ledge 50 to define an enlarged rectangular recess 51 opening outwardly toward base 18. Base 18 is interfittingly received with a tight fit in recess 51 and seats against ledge 50 such that the interior face of base 18 is uniformly spaced a short distance from the interior of the cover's top wall 30. The depth of recess 51 is about equal to the thickness of base 18 so that the outer flat face of base 18 lies flush with the straight edges of skirt 42 in a common plane.

As shown in FIGS. 6 and 8, each of the slides 21–28 is integrally formed with a flexible, flat-bottomed, thin, rectangular base portion 54 and a button portion 56 protruding upwardly from base portion 54.

The base portion 54 of each of the slides 21–28 lies between the opposing interior faces of base 18 and cover 16. Each button portion 56 projects through one of the apertures 31–38. The base portion 54 of each indexing slide has a width which is greater than the width of each of the apertures 31–38. Thus, the base portion 54 of each slide is confined or trapped between cover 16 and base 18. By this construction, each of the slides 21–28 is retained in assembled relation with cover 16 and base 18 and is slidable between its point recording and non-recording positions as described above.

On the underside of each base portion 54 is a downwardly extending protrusion 58 which is arranged to coact with a pair of longitudinally extending, parallel spaced apart grooves 60 and 62 in base 18 to define two detents for releasably locking each indexing slide in its non-recording and recording positions. As shown, grooves 60 and 62 open inwardly into the interior of unit 12 and extend throughout the full length of base 18 normal to the direction in which slides 21–28 are slidable.

When each of the slides 21–28 is shifted to its left-hand non-recording position, its protrusion 58 seats in groove 60. In this manner, each of the slides 21–28 will be releasably locked by the detent action of its protrusion 58 and groove 60 in its extreme left-hand position. Likewise, each of the slides 21–28, upon being shifted to its right-hand point-recording position, will be so located that its protrusion 58 seats in groove 62. Each of the slides 21–28 will therefore be releasably locked by the detent action of protrusion 58 and groove 62 in its extreme right-hand position.

As shown in FIGS. 6 and 8A, the base portion 54 of each of the slides 21–28 is formed with a pair of protuberances 59. Protuberances 59 project upwardly from the side of the base portion on which the button portion 56 is disposed.

As shown, protuberances 59 are disposed along the marginal end regions of base portion 54 in spaced relation to button portion 56. Protuberances 59 prevent slides 21–28 from tilting or leaning in the direction in which the indexing slides are pushed as they are slidably shifted in either direction from one releasable locking position to another.

The dimensions of component parts are such that when protrusion 58 is seated in one of the grooves 60 and 62 the flat bottom of base portion 54 will seat against the flat face of base 18 and protuberances 59 will slidably contact the inwardly facing wall surface of top wall 30. When each indexing slide 21–28 is shifted to an intermediate position between its releasable locking positions, protrusion 58 will ride on the flat inner surface 64 of base 18, causing the central portion of the index slide and particularly the central part of base portion 54 lying in the region of protrusion 58 to flex or bulge outwardly in the slide's associated apertures (31–38). Thus, as each slide is shifted to a position where its protrusion 58 begins to enter one of the grooves 60 and 62, it will snap into place to provide a positive, but releasable locking action.

As best shown in FIG. 7, base 18 is integrally formed with a thin, elongated, strip portion 65 and a plurality of shorter, flat-sided, thin strip portions 66. Strip portions 65 and 66 are arranged in the manner shown to stiffen and oppose flexure of the assembly of cover 16 and base 18 as slides 21–28 are pushed from one position to another. The interior face of the cover's top wall 30 seats against strip portions 65 and 66. An adhesive applied to regions of strip portions 65 and 66 and the marginal edges of base 18 firmly join base 18 and cover 16 together in a unitary assembly.

Referring to FIGS. 1B and 9–13, unit 14 is in several respects is identical in construction to unit 12 and comprises a rectangular, one-piece base 70, a rectangular, one-piece cover 72 overlying and seated on base 70 and four indexing buttons or slides 81, 82, 83 and 84. As will be described in detail shortly, slides 81 and 82 are arranged to score the number of games won by the opposing players, and slides 83 and 84 are arranged to score the number of sets won by the opposing players.

Base 70, cover 72 and slides 81–84 are advantageously molded from a suitable plastic material. Base 70 and cover 72 are firmly joined together in assembled relationship by a suitable adhesive.

Cover 72 is of the same construction as cover 16 except for the number and orientation of apertures formed through the cover's top wall. The portions of cover 72 corresponding to cover 16 (specifically, the top wall, skirt and interior ledge) have been designated by corresponding reference numerals suffixed by the letter a.

In place of the eight apertures 31–38 used in unit 12, cover 72 is provided with only four rectangular apertures 91, 92, 93 and 94. Apertures 91–94 are formed through top wall **30*a*** as shown.

Base 70 is also of the same construction as base 18 with the exception that base 70 is formed from a multiplicity of grooves 101, 102, 103, 104, 105, 106, 107, 108, 109, 110 and 111 in place of grooves 60 and 62. The purpose of grooves 101–111 will be described shortly.

As shown, base 70 is interfittingly received with a tight fit in the cover's recess **51*a* and seats against ledge 50*a* such that the interior face of base 70 is uniformly spaced a short distance from the interior of the cover's top wall 30*a*. The outer flat face of base 70 lies flush with the straight edges of skirt 42*a*** in a common plane.

Slides 81–84 extend through apertures 91–94, respectively, for manipulation and are of the same construction as slides 21–28. Accordingly, corresponding reference numerals suffixed by the letter a have been applied to designate the portions of slides 81–84.

As shown in FIG. 1B, apertures 91 and 92 are coextensive, are arranged in parallel spaced apart relation, and are elongated in the direction in which cover 72 is elongated so that they extend parallel to the cover's side walls **44*a*. Similarly, apertures 93 and 94 are coextensive, are arranged in parallel spaced apart relation, and are elongated in the direction in which cover 72 is elongated so that they also extend parallel to the cover's side walls 44*a***.

Apertures 91 and 92 are significantly longer than apertures 93 and 94 as shown. Apertures 93 and 94 lie in the region of cover 72 between one end of the cover and the cover region in which apertures 91 and 92 are located. Apertures 91–94 are located and are arranged in such a manner that apertures 93 and 94 are aligned in end-to-end relation with apertures 91 and 92, respectively. As shown, apertures 91–94 are symmetrically arranged about a longitudinal plane, with apertures 91 and 93 being disposed on one side of the plane and with apertures 92 and 94 being disposed on the other side of the plane.

As best shown in FIG. 12, grooves 101–111 are parallel, are formed in the interior face of base 70 to open into the interior space delimited by cover 72 and base 70, and extend transversely across base 70 from one side edge to the other at right angles to side walls **44*a* and apertures 91–94. Grooves 101–108 are arranged in a first group and are uniformly spaced apart in a region where they traverse apertures 91 and 92. Grooves 109–111 are arranged in a second group and are uniformly spaced apart in a region where they traverse apertures 93 and 94**.

As shown, base 70 is formed with an elongated strip portion 114 on its interior face. Strip portion 114, which bridges grooves 101–111, extends from one edge of base 70 to the other at right angles to grooves 101–111. As shown, strip portion 114 is midway between the elongated side edges of base 70 and is parallel to apertures 91–94 so that it lies midway between apertures 91 and 93 on one side and apertures 92 and 94 on the other. Top wall **30*a* seats against and may be glued to strip portion 114 as shown. As such, strip 114 defines a reinforcing rib to resist flexure of base 70 and cover 72**.

Similar to the construction in unit 12, the base portion **54*a* of each of the slides 81–84 lies between the opposing interior faces of base 70 and cover 72, and each button portion 56*a* projects through an associated one of the apertures 91–94. The base portion 54*a* of each slide has a width greater than the width of each of the apertures 91–94 to retain slides 81–84 in assembled relation with base 70 and cover 72**.

As slide 81 is advanced longitudinally along aperture 91 its protrusion **58*a* successively enters grooves 101–108. The protrusion 58*a* on slide 81 thus coacts with each of the grooves 101–108 to define eight detents for releasably locking slide 81 at eight different, uniformly spaced apart positions along aperture 91. The detent or releasable locking action of protrusion 58*a* in grooves 101–108 as slide 81 is advanced back and forth is the same as that previously described for slides 21–28 and grooves 60 and 62**.

Slide 82 is slidable back and forth longitudinally along aperture 92 from one end of the aperture to the other, and the protrusion 58*a* on slide 82 is arranged to coact with each of the grooves 101–108 to define eight detents for releasably locking slide 82 at eight different uniformly spaced apart positions coinciding with the releasable locking positions of slide 81. The detent or releasable locking action of slide 82 is the same as that described for slide 81.

As shown in FIG. 1B, the numerals 0, 1, 2, 3, 4, 5, 6 and 7 are boldly printed on the exterior region of cover 72 between apertures 91 and 92 in alignment with grooves 101–108, respectively. These numerals mark the aligned, releasable locking positions of slides 81 and 82 for scoring the number of games won by the opposing players.

The protrusion 58*a* of each of the slides 83 and 84 coacts with grooves 109–111 to establish detents for releasably locking each of the slides 93 and 94 in three uniformly spaced apart positions in the same manner just described for slides 81 and 82. Thus, as slides 83 and 84 are slidably advanced longitudinally along apertures 93 and 94, respectively, the protrusion 58*a* of each slide successively enters grooves 109–111 to releasably lock the slide in three separate positions. The three locking positions of slide 84 coincide or align with the locking positions of slide 83. To score the sets, the numerals 0, 1 and 2 are boldly printed on the exterior region of cover 72 between apertures 93 and 94 in alignment with grooves 109–111, respectively.

As shown in FIGS. 9 and 10, each of the grooves 101–111 is formed with a symmetrical V-shaped cross section to permit each of the slides 81–84 to be advanced along apertures 91–94 in either direction. Similar to the construction described for slides 21–28 and cover 16, slight flexure of the base portion 54*a* causes the protrusions 58*a* of slides 81–84 to enter their associated grooves 101–111 with a snap action.

At the beginning of each set slides 81 and 82 are returned to their endmost positions marked "0" in preparation for scoring the games won by the opposing players. Using slide 81 for player A and slide 82 for player B, assume that player A wins the first game of the set. To score this game, slide 81 will be advanced from its "0" position to the next position marked "1". If player A wins the second game of the set, slide 81 is advanced to its next succeeding position marked "2", thus indicating that player A has won two games. If player B wins the third game, slide 82 is advanced from its "0" position to its next position marked "1". The positions of the two slides will now indicate that player A has won two games and that player B has won one game. Scoring of games is continued in this fashion until the winner of the set is determined.

For scoring sets, both of the slides 83 and 84 are returned to the common position marked "0" at the beginning of the match. Assuming that slides 83 and 84 are assigned to players A and B, respectively, and that player A wins the first set, slide 83 is advanced from its "0" position to the next position marked "1", leaving slide 84 in the position marked "0" to signify that the score in sets is 1 to 0 in favor of player A.

If player A wins the second set in the best-three-out-of-five match, slide 83 is then advanced to the next position marked "2", so that observation of slides 83 and 84 indicates that player A has won two sets and player B has won none. If the match is the best-two-out-of-three sets, it is apparent that the position marked "2" is not needed.

Referring to FIGS. 2–4, scorekeeping units 12 and 14 may be assembled with a tennis racquet 120 in the manner shown. Alternatively, units 12 and 14 may be mounted on a separately supplied base plate 122 (see FIG. 14).

The construction of racquet 120 is typical of most commercially available tennis racquets. As shown, the handle of racquet 120 is indicated at 124 and extends in the usual manner from the racquet head 126. Handle 124 is conventionally formed with a neck portion 128 extending between the handle grip portion 130 and the frame of the racquet head. The opposite sides of the racquet handle neck indicated at 134 and 136 in FIG. 4.

Units 12 and 14 may advantageously be mounted on the oppositely facing sides 134 and 136 of the racquet handle neck 128 in the region between the handle grip portion 130 and the racquet frame such that the racquet handle neck is sandwiched between the two scorekeeping units in the manner shown in FIGS. 2–4.

To simplify the mounting of the scorekeeping units, each of the units 12 and 14 is provided with a two sided tape or a flexible, resilient adhesive backing pad 140 with adhesive on both sides as best shown in FIGS. 5 and 11. Pads 140 are rectangular and are firmly joined by a suitable adhesive to the outer flat faces of bases 18 and 70. The widths and lengths of pads 140 are preferably slightly smaller than the corresponding dimensions of bases 18 and 70 so that pads 140 do not extend beyond the edges of bases 18 and 70 as shown. A suitable adhesive is applied to the outer faces of pads 140 for mounting the scorekeeping units on the racquet handle neck. By this construction, units 12 and 14 are easily and quickly secured to the racquet handle neck simply by positioning units 12 and 14 in such a manner that pads 140 of the scorekeeping units seat against the opposite side faces 134 and 136 of the racquet handle neck and then by firmly pressing units 12 and 14 against the racquet handle. In this manner, units 12 and 14 will be firmly secured to the racquet handle without the use of fasteners of any kind.

As shown in FIGS. 2–4, units 12 and 14 are positioned on the racquet handle in such a way that they extend longitudinally of the handle. By positioning units 12 and 14 in this manner, the longitudinal axis or dimension of each scorekeeping unit will be parallel to the longitudinal axis of handle 124. Preferably, units 12 and 14 are positioned in such a way that a longitudinal plane containing the longitudinal axis of the racquet handle medially intersects units 12 and 14.

The overall or maximum width of unit 12 is defined by the dimension between the oppositely facing surfaces of the cover side walls 44. The overall or maximum length of unit 12 is defined by the dimension between the opposite facing surfaces of the cover end walls 46, and the depth or thickness of unit 12 is defined by the dimension between the oppositely facing surfaces of pad 140 and top wall 30. The overall width, length and depth of unit 14 are defined in the same way and are preferably equal to the width, length and depth of unit 12. The housing or casing structure defined by cover 72 and base 70 in unit 14 therefore has overall or exterior dimensions (i.e., width, length, and depth) equal to that of the housing or casing structure which is defined by cover 16 and base 18 in unit 12.

The equal widths of units 12 and 14 are small enough so that units 12 and 14 do not extend laterally beyond the racquet handle when they are centrally positioned on the racquet handle in the manner shown in FIGS. 2 and 3. Additionally, the equal lengths of units 12 and 14 is somewhat smaller than the longitudinal dimension of the racquet handle neck between the handle grip 130 and head 126. Units 12 and 14 therefore lie entirely between the racquet handle grip 130 and head 126 in positions where they do not interfere with the use of the racquet.

Furthermore, the equal depths of units 12 and 14 are very small so that units 12 and 14 do not project significantly from the opposite side of the tennis racquet handle. Units 12 and 14 are also of approximately equal weight and are of lightweight construction as described.

When units 12 and 14 are secured to the opposite sides of the racquet handle neck 128 in the manner shown in FIGS. 2–4, they overlie the racquet's center of gravity. By virtue of positioning units 12 and 14 in this manner and by virtue of the equal overall dimensions of the two scorekeeping units and their approximate equal weights, the balance of the racquet is not upset when units 12 and 14 are mounted in place on the racquet handle. Furthermore, it will be appreciated that the original balance of the racquet is effectively preserved by using two scorekeeping units, one on each side of the racquet handle.

From the foregoing description it is evident that units 12 and 14 are slim, compact and efficiently organized, as well as being structured to preserve the balance of the racquet and to avoid interference with the use of the racquet during play. Additionally, both scorekeeping units 12 and 14 are conveniently located on the racquet in such a way that each of the score-indicating slides 21–28 and 81–84 may easily be reached for manipulation by the player's thumb while the player is holding the racquet in one hand and one or more balls in the other hand.

In the embodiment shown in FIGS. 2–4, it will be appreciated that the scorekeeping units may be assembled on virtually any existing tennis racquet and that no modification to racquet 120 is required in order to mount the scorekeeping units 12 and 14 on the racquet handle. In comparison with this arrangement, racquet handle 124 may be formed with two outwardly opening, shallow, flat-bottomed recesses 148 and 149 (see FIGS. 16 and 17) during manufacturing the racquet. The recesses 148 and 149 are formed in the oppositely facing sides 134 and 136 of the racquet handle neck, and units 12 and 14, less pads 140, are interfittingly seated in recesses 148 and 149, respectively. The depth of recesses 148 and 149 are such that the outer or top wall surfaces of covers 16 and 72 lie flush with the racquet side surfaces 134 and 136, respectively. Units 12 and 14 may be firmly secured in place in recesses 148 and 149 by an adhesive between bases 18 and 70 and the flat bottoms of recesses 148 and 149. It will be noted that the racquet handle side surfaces 134 and 136 are extensions of the opposite side faces of the racquet head frame and lie parallel to the racquet face or, more specifically, the plane of the stringing in the racquet head.

Mounting plate 122 provides the user with the option of using units 12 and 14 as a single, unitary hand-held assembly, as indicated generally at 152. The assembly of units 12 and 14 with plate 122 is simply and easily accomplished by positioning units 12 and 14 in side-by-side relationship on plate 122 with pads 140 seated against a flat face of the plate and when pressing units 12 and 14 firmly against the plate to adhesively secure units 12 and 14 to plate 122. Plate 122 provides a rigid backing or support for units 12 and 14 to maintain the scorekeeping units in assembled relation with each other. The unitary scorekeeping assembly 152 is relatively small and can easily be cradled in one hand by a spectator or umpire for keeping the score in points, games and sets as the match progresses.

A modified form of a scorekeeping unit 160 for scoring game points is shown in FIG. 17. To the extent that units 160 and 12 are the same like reference numerals have been applied to designate corresponding parts. Unit 120 differs from unit 12 in two major respects as will now be explained.

In place of the two separate groups of apertures 31–35 and 35–38, the cover 16 of unit 160 is formed with seven centrally located, uniformly spaced apart, parallel apertures 161, 162, 163, 164, 165, 166 and 167. Apertures 161–167 are rectangular, are arranged in a single row and are elongated in a direction extending transversely of cover 16 as shown. Only seven indexing slides are used in unit 160 as indicated at 171, 172, 173, 174, 175, 176 and 177. Slides 171–177 are of the same construction as slides 21–28 and project through apertures 161–167, respectively.

In place of the two detent grooves 60 and 62, the base 18 of unit 160 is formed with three parallel, longitudinally extending detent grooves 180, 181 and 182. Grooves 180–182 are traversed by apertures 161–167 and are so arranged that groove 180 extends in the region of the left hand ends of apertures 161–167, groove 181 extends centrally of apertures 161–167 and groove 182 extends in the region of the right hand ends of apertures 161–167. By this construction, the protrusion 58 of each of the slides 171–177 will enter grooves 180–182 as the slide is shifted longitudinally from one extreme position to the other in its associated apertures (161–167).

When each of the slides 171–177 is shifted from one extreme position to the other its protrusion 58 successively enters and seats in grooves 180–182 to provide the detent action for releasably locking each of the slides 171–177 in three spaced apart positions, one being at the left hand end of the apertures 161–167, the second being at the right hand end of apertures 161–167, and the third being centrally between the right and left hand ends of the apertures. This third locking position is therefore centrally between the extreme right hand and left hand locking positions and is a neutral or non-recording position. The left hand locking position of slides 171–177 is used to record points for one player or pair of players, and the right hand locking position of slides 171–177 is used for recording or scoring points won by the opposing player or pair of players. The detent or releasably locking action of slides 171–177 is the same as that previously described for slides 21–28. As compared with slides 21–28, however, slides 171–177 have three locking positions rather than two.

Assume that the left hand releasable locking positions are assigned to player A, and that the right hand releasable locking positions are assigned to player B. Slides 171–177 are all shifted to their central non-recording positions before the game begins. If player A wins the first point of the game, slide 171 is shifted to its extreme left hand position. If player A wins the second point, the second slide in the row, namely slide 172, is also shifted to its extreme left hand position. If player B wins the third and fourth points of the game, slides 173 and 174 are shifted to their extreme right hand positions. Points are recorded in this manner until the game is won by one player or the other. Accordingly, the recorded score is determined by the number of slides shifted to their left hand positions and the number of slides shifted to their right hand positions. The advantage of this point scoring arrangement over the one shown in FIG. 1A is that it enables the scoring of points to quickly be reconstructed simply by observing the positions of slides 171–177. As is apparent from the foregoing description slides 171–177 are used in order of their numbering to score or record successive points.

To readily distinguish the left hand and right hand positions of one another, the left hand edges of apertures 161–167 may be painted one color, such as yellow, and the right hand edges of apertures 161–167 may be painted white or some color other than yellow. Similarly, slides 21–24, 81 and 83 may be painted yellow and slides 25–28, 82 and 84 may be painted white so that the two separate sets of slides used for or assigned to opposing players do not become confused.

By using a two-sided adhesive tape or pad (as indicated at 140) to secure units 12 and 14 to the racquet handle, the two scorekeeping units are removably mounted on the handle. The user may therefore switch units 12 and 14 from the racquet to mounting plate 122 and vise versa.

Finally, it will be noted that each of the slides 21–28, 81–84 and 171–177 is rectilinearly slidable in a straight line between its operative or releasably locked positions.

We claim:

1. A tennis scorekeeping assembly for recording the point score, game score and set score in a tennis match and comprising a support structure, first and second portions mounted on said support structure in side-by-side relationship, said first portion being provided with point-scoring indicia, and said second portion being provided with game-scoring indicia and also with set-scoring indicia, a plurality of first indicator elements on said first portion, each of said first indicator elements being selectively operable for scoring a different point scored by each player in a given game and cooperating with said point-scoring indicia for indicating the point score in a given game, a plurality of second indicator elements disposed on said second portion and selectively operable for scoring games in a given set and cooperating with said game-scoring indicia to indicate the game score in a given set, and a plurality of third indicator elements disposed on said second portion and selectively operable for scoring sets in a given match and cooperating with said set-scoring indicia to indicate the set score in a given match.

2. A tennis scorekeeping device comprising first and second tennis scorekeeping units adapted to be mounted in side-by-side relation on a common support plate or on opposites of a tennis racquet handle between the head of the racquet and the handle grip of the racquet, each of said first and second units including an indicator-support structure elongated in a preselected direction and adapted to be fixed to the racquet handle in a position where its direction of elongation corresponds to the direction which the racquet handle is elongated, a plurality of first indicator buttons forming a part of said first unit and mounted on said structure of said first unit for selective displacement independently of each other between a plurality of predetermined spaced apart positions to score points won by opposing players in a given game, said first unit being provided with exposed point score indicia arranged to cooperate with said first indicator buttons for indicating the point score in a given game, a plurality of second indicator buttons forming a part of said second unit and mounted on said structure of said second unit for selective displacement independently of each other between a plurality of predetermined spaced apart positions for scoring games won by opposing players in a given set, and said second unit being provided with exposed game score indicia arranged to cooperate with said second indicator buttons for indicating the game score in a given set.

3. The tennis scorekeeping device defined in claim 2, comprising a plurality of third indexing buttons forming a part of said second unit and mounted on said structure of said second unit for manual displacement between a plurality of spaced apart predetermined positions for scoring sets won be opposing players in a given match, and said second unit further being provided with exposed set scoring indicia arranged to cooperate with said third indexing buttons for indicating the set score in a given match.

4. A tennis scorekeeping unit comprising a support structure elongated in a pre-selected direction and adapted to be stationarily mounted on a tennis racquet handle between the head of the tennis racquet and the handle grip of the racquet in a position where its preselected direction of elongation corresponds to the direction in which said handle is elongated, and manually manipulatable means for keeping the point score in a tennis game and comprising (a) a first set of descrete indicator members supported on said structure for individual selective displacement between point scoring and non-scoring positions and (b) a second set of descrete indicator members supported on said structure for individual selective displacement between point-scoring and non-scoring positions, each indicator member of said first set being manually displaceable from its non-scoring position to its scoring position for scoring a point in favor of one player, and each indicator member of said second set being manually displaceable from its non-scoring position to its point scoring position for scoring a point in favor of an opposing player, the indicator members of said first and second sets being arranged in a row extending in the direction in which said structure is elongated, and said structure being provided with point score indicia arranged to cooperate with the indicator members of said first and second sets for indicating the point score in a given game.

5. The tennis scorekeeping unit defined in claim 4 wherein the indicator members of said first set are grouped together in a first region of said structure, and wherein the indicator members of said second set are segregated from the indicator members of said first set and are grouped together in a second region of said structure that is distinct from said first region.

6. The tennis scorekeeping unit defined in claim 4 wherein each indicator member of said first and second sets is supported on said structure for sliding movement between its point scoring and non-scoring positions, and wherein said structure comprises a base, a cover positioned on and fixed to said base, said cover being formed with a plurality of first apertures corresponding in number to the number of the indicator members in said first set, said cover being further formed with a plurality of second apertures corresponding in number to the number of the indicator members in said second set, each indicator member of said first set extending through a different one of said first apertures for manual manipulation and having a portion confined between opposing surfaces of said cover and said base, each indicator member of said second set extending through a different one of said second apertures for manual manipulation and having a portion confined between the opposing surfaces of said base and said cover, and coacting means on said base and the indicator member of each of said first and second sets for releasably locking each indicator member of each set in its scoring and non-scoring positions.

7. The tennis scorekeeping unit defined in claim 4, there being four indicator members in said first set and four indicator members in said second set, said indicia comprising a first group of four characters respectively designating the point scores of 15, 30, 40 and ADD, each of the characters in said first group being located next to a different one of the indicator members of said first set for assigning a different point score value to each indicator member in said first set, and said indicia further including a second group of four characters respectively designating the point scores of 15, 30, 40 and ADD, and each of the characters in said second group being located next to a different one of the indicator members of said second set for assigning a different point score value to each indicator member in said second set.

8. The tennis scorekeeping unit defined in claim 7 wherein the indicator members of said first set are the first four consecutive indicator members in said row.

9. The tennis scorekeeping unit defined in claim 8 wherein each of the indicator members of said first and second sets is slidably supported on said structure for sliding movement between its point-scoring and non-scoring positions.

10. The tennis scorekeeping unit defined in claim 9 wherein the point scoring positions for the indicator members of said first and second sets are located in a first straight row, and wherein the non-scoring positions for the indicator members of said first and second sets are located in a second straight row lying parallel to said first straight row.

11. The tennis scorekeeping unit defined in claim 4 wherein each of the indicator members of said first and second sets is slidably supported on said structure and is slidably shiftable between its point-scoring and non-scoring positions along a path extending transversely of the direction in which said structure is elongated, and each indicator member of said first and second sets being located for thumb manipulation with the user's racquet hand while the user holds the racquet in his racquet hand.

12. A tennis scorekeeping unit comprising an indicator slide-support structure elongated in a pre-selected direction and adapted to be stationarily mounted on a tennis racquet handle between the head of the tennis racquet and the handle grip of the racquet in a position where its pre-selected direction of elongation corresponds to the direction in which said handle is elongated, and manually manipulatable means for keeping the a particular score for opposing players in a tennis match and comprising first and second indicator slides, said first indicator slide being slidably supported on said structure for displacement along a first path, and said second indicator slide being slideably supported on said structure for displacement along a second path extending parallel to said first path, said indicator slides being displaceable along their associated paths independently of each other, and said structure being provided with indicia at least at six spaced apart locations along each of said first and second paths, said first indicator slide being manually shiftable from an initial position to each of said locations along said first path to cooperate with said indicia for indicating said particular score accumulated by one of the opposing players, and said second indicator slide also being manually shiftable from an initial position to each of said locations along said second path to cooperate with said indicia for indicating said particular score accumulated by the other of said opposing players.

13. A tennis scorekeeping unit comprising an indicator slide-support structure elongated in a pre-selected direction and adapted to be stationarily mounted on a tennis racquet handle between the head of the tennis racquet and the handle grip of the racquet in a position where its pre-selected direction of elongation corresponds to the direction in which said handle is elongated, and manually manipulatable means for keeping the point score in a tennis game and comprising a plurality of descrete indicator slides slidably supported on said structure for individual manual displacement between point scoring and non-scoring positions, said structure including a base and an apertured cover fixed to and covering said base, said base having spaced apart grooves corresponding to said scoring and non-scoring positions, and each of said indicator slides being of one-piece construction having (a) a flexible base trapped between said cover and said base, (b) a button portion protruding from one side of said base and extending through an aperture in said cover, (c) a locking projection protruding from the other side of said base in the region just opposite said button portion for releasable seating engagement in different ones of said grooves to releaseably lock the indicator slide in its non-scoring and scoring positions and (d) a pair of protruberances disposed on opposite sides of said region and protruding from said one side of said base for engagement with the interior surface of said cover to oppose tilting movement of the indicator slide as it is shifted between its scoring and non-scoring positions, said projection being positioned to ride along the interior surface of said base between said grooves to flex said region outwardly toward said cover during movement of the indicator slide intermediate its scoring and non-scoring positions.

14. A tennis scorekeeping unit comprising a structure adapted to be stationarily mounted on one side of a tennis racquet handle between the head of the tennis racquet and the handle grip of the racquet, and manually manipulatable means for keeping the score of games in a set of tennis and comprising first and second indicator slides, said first indicator slide being slidably supported on said structure for displacement along a first straight path, and said second indicator member being slidably supported on said structure for displacement along a second straight path, said indicator slides being displaceable along their associated paths independently of each other, said structure being provided with game score indicia at six spaced apart pre-selected locations along each of said first and second paths, each of said indicator slides being manually shiftable from an initial position to each of said locations along its associated straight path and cooperating with the indicia at said locations for indicating the number of games won by a different one of two opposing players, said structure comprising a base and a cover positioned on and fixed to said base, said cover having first and second parallel spaced apart coextensive apertures respectively disposed on opposite sides of a plane medially intersecting the cover, said base, said cover and said apertures being elongated in a common pre-selected direction, said first and second indicator slides respectively extending through said first and second apertures for manual displacement therealong, said first and second indicator slides each having a portion confined between said base and said cover to retain the indicator slides in assembled relation with said base and said cover, and third and fourth indicator slides each having a portion confined between said base and said cover, said cover being formed with third and fourth parallel, spaced apart coextensive apertures respectively disposed on opposite sides of said plane, said third and fourth indicator slides respectively extending through said third and fourth apertures for manual manipulation, said third indicator slide being manually displaceable along said third aperture from an initial position to two pre-selected spaced apart positions for scoring the number of sets won by one of two opposing players or by one of two opposing pairs of players, and said fourth indicator slide being manually displaceable along said fourth aperture from an initial position to two pre-selected spaced apart positions for scoring the number of sets won by the other of the opposing players or pair of players, said structure being provided with set-scoring indicia at said pre-selected positions for said third and fourth indicator slides to cooperate with said third and fourth indicating slides for indicating the number of sets won by the opposing players.

* * * * *